United States Patent [19]

Thorsen

[11] 4,300,367

[45] Nov. 17, 1981

[54] APPARATUS FOR TREATMENT OF FIBERS WITH OZONE-STEAM MIXTURES

[75] Inventor: Walter J. Thorsen, Albany, Calif.

[73] Assignee: The United States of America as represented by the Secretary of the Department of Agriculture, Washington, D.C.

[21] Appl. No.: 219,569

[22] Filed: Dec. 24, 1980

Related U.S. Application Data

[60] Continuation-in-part of Ser. No. 88,674, Oct. 26, 1979, abandoned, which is a division of Ser. No. 15,503, Feb. 23, 1979, Pat. No. 4,214,330.

[51] Int. Cl.[3] ..... D06B 3/30
[52] U.S. Cl. ..... 68/5 D
[58] Field of Search ..... 68/5 C, 5 D, 5 E

[56] References Cited

U.S. PATENT DOCUMENTS

| | | | |
|---|---|---|---|
| 2,833,136 | 5/1958 | Prince et al. | 68/5 D |
| 3,149,906 | 9/1964 | Thorsen | 8/128 R |
| 3,982,481 | 9/1976 | Console et al. | 99/477 |

FOREIGN PATENT DOCUMENTS

| | | | |
|---|---|---|---|
| 658728 | 10/1951 | United Kingdom | 68/5 C |

OTHER PUBLICATIONS

U.S. Dept. of Agriculture, Misc. Publication No. 540, "Vegetable and Fruit Dehydration-A Manual for Plant Operators", Jun. 1944, p. 40.

*Primary Examiner*—Philip R. Coe
*Attorney, Agent, or Firm*—M. Howard Silverstein; David G. McConnell; Margaret A. Connor

[57] ABSTRACT

Fibers are treated with ozone-steam mixtures by conveying them through an open-ended chamber having a horizontal middle section substantially elevated with respect to the open chamber end. The fibers are exposed to the ozone-steam mixture in the horizontal middle section wherein the ozone is centrally introduced.

An apparatus for carrying out this method includes an open-ended chamber having a horizontal middle section substantially elevated with respect to the open chamber end. Also included are means for moving the substances through the chamber, means for centrally supplying ozone to the horizontal middle region of the chamber and means for supplying steam to the horizontal middle region of the chamber.

8 Claims, 5 Drawing Figures

APPARATUS FOR TREATMENT OF FIBERS WITH OZONE-STEAM MIXTURES

This is a continuation-in-part of my copending application, Ser. No. 88,674, filed Oct. 26, 1979, now abandoned, which in turn is a divisional of Ser. No. 15,503, filed Feb. 23, 1979, now U.S. Pat. No. 4,214,330.

BACKGROUND OF THE INVENTION

1. Field of the Invention

This invention relates to and has among its objects the provision of novel apparatus for treatment of fibers with ozone-steam mixtures. It is a particular object of the invention to provide novel apparatus for treating proteinous animal fibers with ozone-steam mixtures in order to shrinkproof them. Further objects of the invention will be evident from the following description wherein parts and percentages are by weight unless otherwise specified.

2. Description of the Prior Art

A process for treating animal fibers with gaseous ozone and steam is described in U.S. Pat. No. 3,149,906 (hereinafter referred to as '906). A stream of ozone and steam is blown through the textile under treatment in the '906 process.

A disadvantage of the known process is that ozone is not used efficiently and losses of 80–85% of ozone usually occur. Inefficient use of ozone is costly because large amounts of energy are expended to both produce the ozone and to destroy the unused gas. Furthermore, larger ozone generators are required when excess amounts of ozone must be prepared and such large generators are expensive.

Closed chambers for treating food material with steam are known. In U.S. Pat. No. 3,982,482 a food product is passed into a chamber which is sealed to prevent escape of steam. The product enters the chamber first through water and then through a combination of a paddle wheel and flap, all of which maintain the chamber steam-tight. For removal of the product from the chamber, the above sequence is reversed. Sealed steam chambers are cumbersome to use and impractical for uses other than as a blanching apparatus for food material.

A hump-back tunnel blancher is described in "Misc. Publication 540," U.S. Department of Agriculture, p. 40 (1944). The center of the tunnel is located at a higher elevation than either the entrance or discharge ends. Steam is maintained in the tunnel center to the exclusion of air by the difference in density between steam and air at ordinary temperatures, by the use of curtains, and by positioning the steam jets so as to neutralize the kinetic energy of the jets.

SUMMARY OF THE INVENTION

I have discovered a method for treating fibers with ozone-steam mixtures wherein the substance is conveyed through an open-ended chamber having a horizontal middle section substantially elevated with respect to the open end of the chamber. The substance is exposed to the ozone-steam mixture in the horizontal elevated middle region of the chamber wherein the ozone is centrally introduced and the steam is introduced at any point in the elevated middle region, preferably centrally. Quite surprisingly, the ozone gas, as well as the steam, is confined to the elevated middle section with little loss of ozone at the open end of the chamber.

An apparatus in accordance with the above method comprises an open-ended chamber having a horizontal middle section substantially elevated with respect to the open chamber end. Also included are means for moving the substance through the chamber and means for centrally supplying ozone to the middle region of the chamber and means for supplying steam to the middle region of the chamber.

An important advantage of the present invention is that fibers may enter and exit the instant apparatus without special precaution needed in closed systems. Consequently, my invention enjoys greater ease of operation than known methods and apparatus. Furthermore, the equipment employed is of a simple nature.

Continuous-type processing has a number of advantages over a batch-wise procedure; for example, conservation of time and energy, less complicated operation, reduced size of equipment, and so forth.

My apparatus also has the unexpected advantage with respect to treatment of proteinous animal fibers with ozone-steam mixtures, namely, that ozone is much more efficiently used than in prior processes, wherein more than 80% of the ozone escapes unreacted. Indeed, less than 10% of the ozone employed is unused in my apparatus. This greatly enhanced efficiency is completely unpredictable in view of the known methods. Obviously, this results in savings of time and money on the part of the processor in generation of ozone, in destruction of unused ozone, and in the reduced size of the ozone generator itself.

Another advantage of my invention is that the advantages of the known processes of shrinkproofing fibers with ozone in general are retained in my apparatus. These advantages include imparting high shrinkresistance to the fibers, short duration of treatment (1–10 minutes), minimum fiber degradation, retention of fiber strength and tensile properties, whiter fabrics, increased dyeability, and dye fastness, and so forth.

DESCRIPTION OF THE PREFERRED EMBODIMENT

The apparatus of the invention will next be described in detail with reference to the annexed drawings. In the description that follows apparatus for treating proteinous animal fibers with ozone will be described by way of illustration and not limitation. In its broad ambit the apparatus and method of the invention can be employed to treat fibers of all kinds with gas-steam mixtures. For example, my invention finds utility in treating cotton fibers or fabrics to bleach them. The particular embodiments of my invention depicted in the attached drawings may be employed for shrinkproofing proteinous animal fibers of all kinds, e.g., wool, mohair, and the like, or blends of these fibers with non-proteinous fibers such as cotton, polyester, acrylic, etc. All types of fiber assemblies may be treated in my apparatus including woven or knitted fabrics, garments, yarns, top, and loose fibers.

Figure 1:
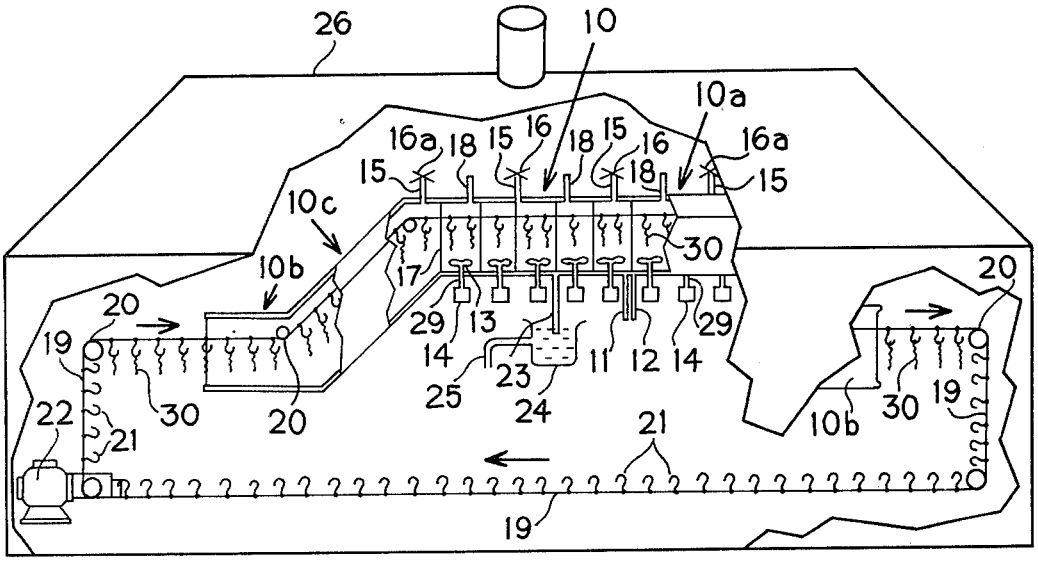
FIG. 1 is a side elevational view of the apparatus of the invention with partial cutaway of exterior casing and ventilation hood.
Figure 2:
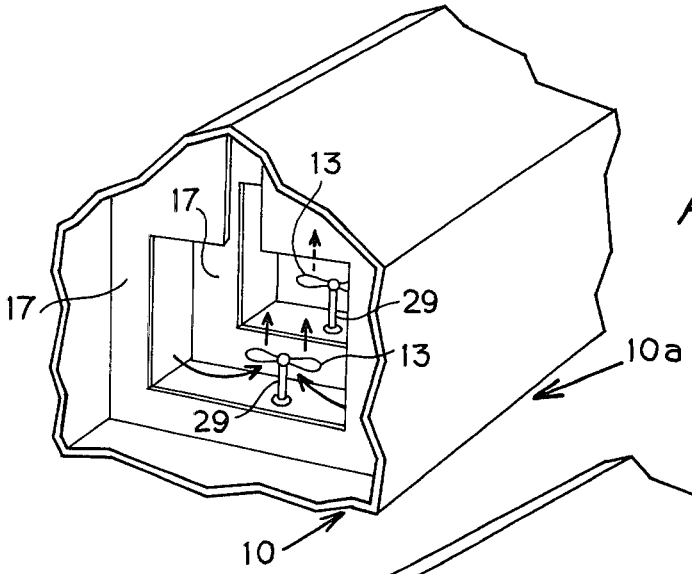
FIG. 2 is an isometric cross-sectional view of a portion of the above apparatus.

In FIG. 1, chamber 10 is a hollow tunnel with a horizontal middle section 10*a*. Ends 10*b* of chamber 10 are also horizontal and 10*a* is elevated with respect thereto; sloping sections 10*c* link 10*a* with 10*b*. Chamber 10 is designed not only to confine the hot ozone-steam mixture within 10*a* and minimize escape of ozone and steam through the ends of sections 10*b*, which are open to the surroundings, but also to minimize lateral movement of the ozone-steam mixture along 10*a*. Thus, in my apparatus the hot ozone-steam mixture remains in elevated middle section 10*a*. The dimensions of 10 are not critical except that middle section 10*a* should be sufficiently elevated with respect to sections 10*b* so that the hot gases will not escape from 10*a* through sections 10*b* and will not move along 10*a*. The critical dimension for such purpose is achieved by maintaining the elevation of the bottom wall of 10*a* a minimum of about 15 to 20 cm above the top wall of 10*b*. This minimum elevation of the horizontal middle section above the end section is critical to confine the buoyant ozone-steam mixture within the elevated middle section. Since the mixture is at a higher temperature and lower density than the unheated air in sections 10*c* or 10*b* it remains within the middle section which is elevated above the end section and is blocked from exit by the cold dense air in sections 10*c* and 10*b*. This phenomenon also minimizes lateral movement of the ozone and steam from the point of inlet into the middle section laterally along 10*a*.

Generally, good results are obtained if section 10*a* is long enough to contain the number of fiber assemblies or fabrics that are to be treated in a given time. For example, if it is desired to treat forty fabrics per minute and the treatment time required is one minute, section 10*a* would have to be long enough to contain forty fabrics (properly spaced to permit good circulation of gases). The width and height of 10*a* are dependent on the size and nature of the fabric to be treated. Section 10*a* should be small enough to maintain the ozone-steam mixture in the vicinity of the fabric to be treated. To this end, the spacing between the walls of the apparatus and the edges of the fibers being treated should be about 5–15 cm. The middle section 10*a* must be of sufficient length to provide a residence time of the fabrics within 10*a* sufficient for treatment of the fabrics with the ozone-steam mixture prior to exiting said middle section. Chamber 10 may be fabricated from any airtight material unreactive to ozone, such as stainless steel, aluminum, Teflon, polyvinylchloride, poypropylene, polyethylene, and the like. It is usually desirable to cover chamber 10*a* with a conventional insulating material to minimize the loss of heat through its walls.

Sole ozone inlet tube 11 is fixedly attached to 10*a* at (or near) its center. Steam inlet 12 is fixedly attached to 10*a*. If only one steam inlet is used as shown in FIGS. 1–5, it is preferably located at the center of 10*a*. In some cases more than one steam inlet may be provided as necessary to provide the required reaction temperature. The locations must be at a distance from the ends of 10*a* to substantially prevent the warming of the air in 10*c*. The central introduction of ozone allows the reactive ozone (mixed with air or oxygen) to efficiently react with the materials being treated as the ozone passes from the center of 10*a* to its end. Use of the chamber structural features of a sole inlet for ozone located at a position essentially central along 10*a* in combination with a horizontal middle section elevated at a level sufficient to confine the hot ozone-steam mixture within 10*a* and minimize lateral movement along 10*a* causes the ozone concentration to be greatest at the center of the elevated middle section, diminishing outwardly toward the ends of 10*a*. This concentration gradient ensures that the ozone generated reacts with the fabrics in the center of 10*a* with little reaching the open ends. The amount that does dissipate towards the end is at a much lower concentration, and since the lateral movement is slow, it is in intimate contact with the fibers to be treated throughout the passage along 10*a*, thus, less than 10% of the ozone injected is unused and usually 94–95% of the ozone is absorbed by the materials prior to exiting 10*a*.

Fans 13 are rotatably mounted in the bottom wall of 10*a* and are driven by variable speed motors 14, to which they are linked by sealed shafts 29 through the bottom wall of 10*a* to circulate the gas mixture within 10*a*. Tubes 15 are positioned at the top wall of 10*a* and are fitted with valves 16, which may be opened to withdraw small samples of ozone-steam mixture for concentration analysis. Cross-sectional baffles 17 (see also FIG. 2) conform to the walls of 10*a* and have openings which allow the fabric to pass therethrough. Baffles 17 are not required for successful operation of my apparatus. However, more efficient use of ozone is realized when baffles 17 are incorporated into the instant apparatus because the ozone-steam mixture circulation is maintained in the area surrounding the individual fabrics or fibers being treated. For temperature monitoring, thermocouples 18 are mounted atop 10*a*. It should be obvious, however, that other means for monitoring the temperature of the reaction may be used. Conveyor 19 travels through 10 on pulleys 20. Suspended from 19 are hooks 21 for carrying the fabric to be treated. The conveyor (19) is driven by variable speed motor 22 at a speed to obtain the desired time of treatment. Generally, the fabric should be exposed to the ozone-steam mixture for a period of about 1 to 10 minutes in order to obtain the proper level of shrinkproofing.

Outlet tube 23 is fixedly attached to the bottom wall of 10*a* and communicates with receiver 24. In this way, water that condenses in 10*a* will exit through 23, be collected in 24, and exit through 25 to a drain. The ozone-steam mixture in 10*a*, however, will not escape through 23. In this respect, another important feature of 10*a* should be noted. The top wall of 10*a* is sloped (see FIGS. 2 and 3) to insure that water droplets condensing on the top wall will be conveyed down the side walls to the bottom walls. This is important in the present invention because water droplets that fall on the fabric cause stained or bleached spots. In the particular embodiment depicted in the attached drawings, the top wall of 10*a* is sloped in both directions from a center line. Other types of sloping may be used and are within the scope of this invention.

The apparatus of the invention should include a means for trapping any unused ozone, however slight, emerging from the open ends of sections 10*b* to prevent escape into the surroundings. Any convenient means for achieving this result may be employed; for example, exhaust hood 26 can be used.

Figure 3:
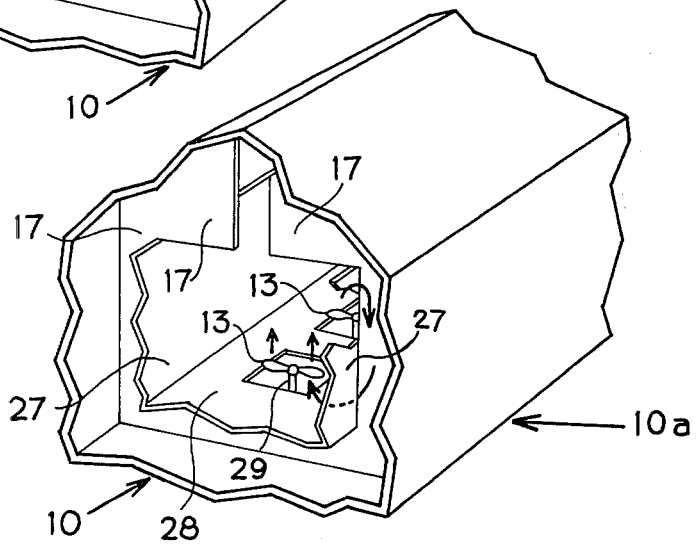
FIG. 3 is an isometric cross-sectional view of an alternate embodiment of the above apparatus.

An alternate embodiment of the invention is depicted in FIG. 3. Interior auxiliary side and bottom walls 27 and 28, respectively, conform to the openings in baffles 17 and are continuous throughout 10a. Bottom auxiliary wall 28 has openings above each of fans 13 to allow the ozone-steam mixture to enter the inner core of 10a. The advantages of this particular embodiment are explained hereinbelow.

Figure 4:
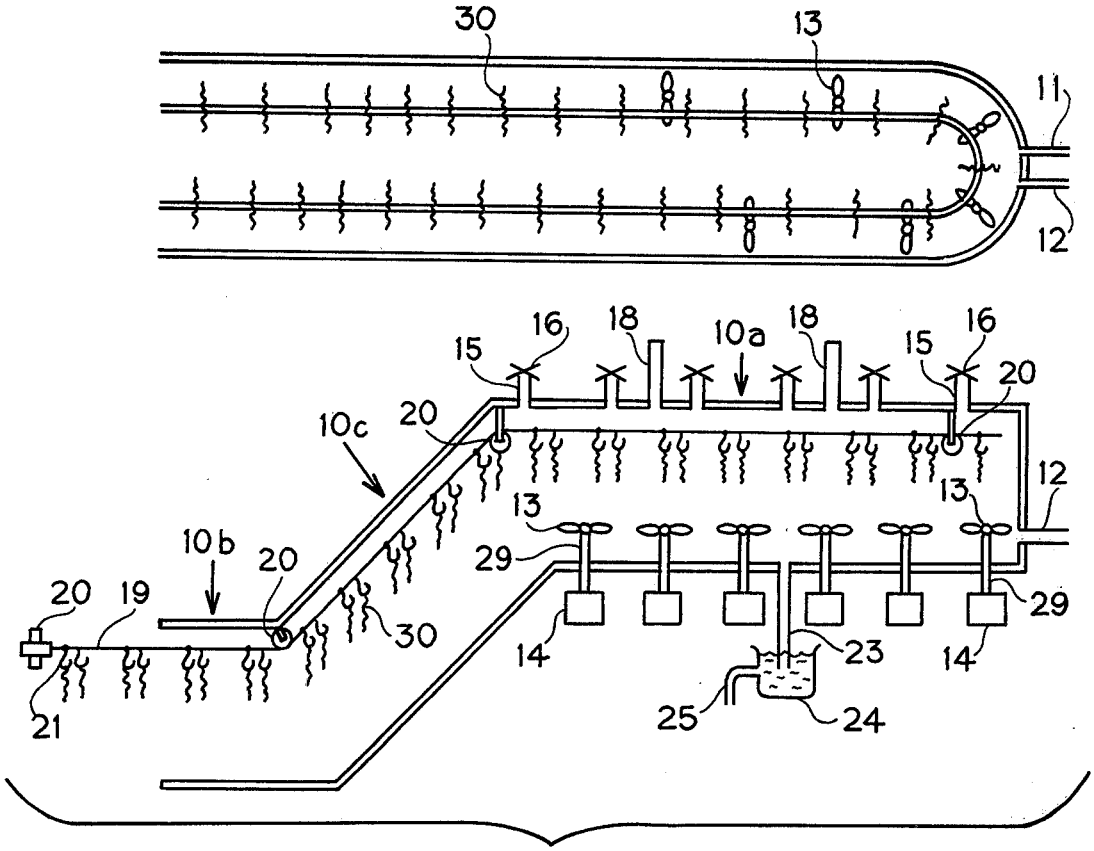
FIG. 4 is a top and side elevational view of an alternate embodiment of an apparatus in accordance with the invention.

Another embodiment of the invention is shown in FIG. 4. Chamber 10 has only one open end section 10b and one section 10c. The fabric enters 10b, travels up 10c to 10a, reverses direction, travels through 10c and exits through 10b, the same opening through which it entered the apparatus.

Figure 5:
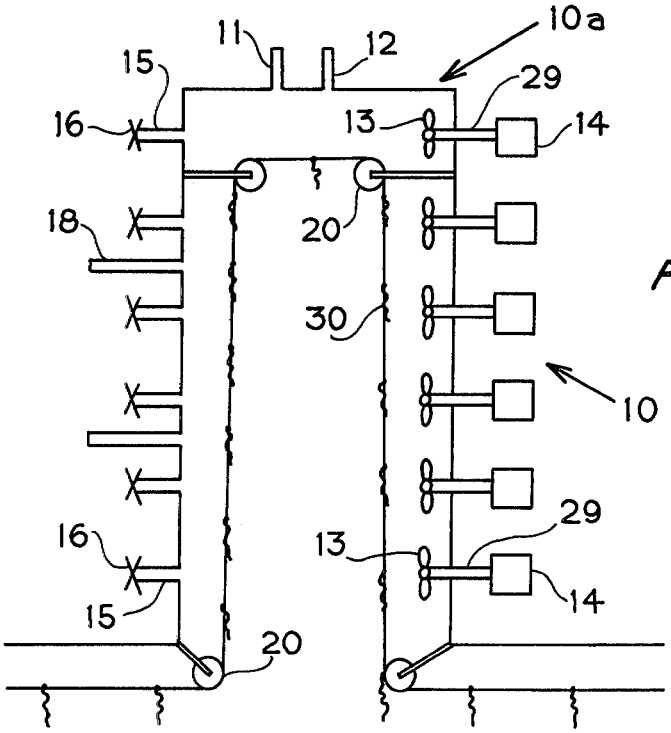
FIG. 5 is a side elevational view of another alternate embodiment of an apparatus in accordance with the invention.

FIG. 5 depicts still another alternate embodiment of the invention. Basically, sections 10b and 10c are absent in this embodiment wherein the horizontal middle section 10a is essentially opposite the open chamber end and the sides of chamber 10 are perpendicular to ground. Thermocouples 18, tubes 15, and valves 16 are located on one side of the chamber and fans 13 are positioned on the other. Inlets 11 and 12 are atop section 10a. Fabric to be treated enters the open end of the chamber, travels vertically upward to 10a, then across 10a, travels vertically downward and exits the chamber.

The operation of my apparatus will next be described, referring to the attached drawings. Fabrics to be shrinkproofed (30) are loaded, either manually or automatically, on conveyor 19 and then passed into chamber 10 at a speed such that the desired residence time of each fabric will be attained. The time of contact between the fibrous material and the aqueous ozone solution is dependent on the reaction temperature, the concentration of ozone, the type of fibrous material being treated, and the degree of modification of the fibrous material that is desired. For example, an increase in reaction temperature or an increase in ozone concentration will increase the speed of modification. In any particular case, pilot trials may be conducted with the material to be treated, employing various conditions and testing the properties of the product. From such tests, the appropriate conditions may be easily derived. In such trials, the shrinkage characteristics of the product may, for example, be used as the criterion and the conditions of reaction selected so that the area shrinkage of the product (tested by a standard method) is markedly improved, i.e., reduced to at least one-half, preferably at least one-tenth, of that displayed by the starting (untreated) material. It is, of course, obvious that the process should not be continued for a period long enough to cause degradation of the fibers. As noted above, the process of the invention is rapid so that effective results are obtained in a matter of minutes, for example, 2 to 6 minutes.

Prior to starting conveyor 19 ozone mixed with air or oxygen is pumped into 10a through inlet 11 at a sufficiently high concentration to obtain good shrinkproofing in the fabric during its passage through 10a. Generally, the ozone is produced in a conventional device wherein oxygen or air is passed through an electrical system involving a high-voltage silent discharge. The effluent gas from this device contains, for example, about from 10 to 100 mg of ozone per liter, depending on the circuit adjustments of the device. (The portion of this gas stream which is not ozone is, of course, oxygen or air (and reference to ozone herein means ozone mixed with either air or oxygen).) This gas stream is mixed with a stream of steam produced by a conventional steam generator and injected into 10a through inlet 12. The proportion of steam being mixed with the ozone is adjusted to attain the desired gas temperature. Thus, by increasing the proportion of steam coming from the steam generator, the temperature of the composite stream may be increased. The temperature at which the process of the invention is carried out may be varied from about 60° to 95° C.

The rate of introduction of the ozone-steam mixture into the horizontal middle section should be sufficient to supply an amount of ozone required to treat the fibers but insufficient to cause ozone to exit the open chamber ends. This rate is dependent both on the concentration of ozone within the composite stream and the rate of passage of fibers through 10a. The rate to be employed in any given treatment can easily be determined by pilot trials and by monitoring the ozone concentration at open ends 10b.

Fans are employed to obtain good circulation of the ozone-steam mixture within 10a and to ensure good contact between this mixture and the fabric. Generally, the gas flow occurs in the direction depicted in FIGS. 2 and 3. The gaseous mixture flows upwardly from the center of the bottom wall of the apparatus, past the fabrics or garments under treatment, aided by fans 13. When the gaseous current reaches the top of 10a the direction changes so that the flow travels along the top wall and downwardly along the side walls. Baffles 17 help to compartmentalize the gas flow. In the embodiment depicted in FIG. 3, auxiliary walls 27 and 28 further aid in compartmentalizing the flow of the ozone-steam mixture. In this way, more efficient ozone utilization is realized; usually, about 94–95% of the ozone generated is absorbed by the fabric. It should be apparent at this point that cross-sectional circulation of the ozone-steam mixture is desirable and indeed, is facilitated by baffles 17. On the other hand, longitudinal movement of the mixture should be minimized, thus containing the gas mixtures in 10a. Consequently, the reaction of the fabrics with ozone is somewhat greater at the center of section 10a and diminishes at the ends of 10a.

Ozone concentration is measured periodically at each of valves 16. Particular attention is directed to valves 16a at the ends of 10a. The concentration of ozone at these points should be low, indicative of efficient use of ozone concentration. In keeping with the principle of the invention, ozone concentration at these terminals should be very minimal, signifying both the efficient use of ozone and the effective maintenance of ozone within elevated section 10a of the instant apparatus.

Water that has condensed on the bottom wall of 10a exits by means of outlet tube 23 and is collected in receiver 24. The design of 23 and 24 must be such as to contain the ozone-steam mixture within 10a and allow water to exit through tube 25 to the drain. This is accomplished by first filling receiver 24 with water up to the level of drain tube 25. Thus, when condensate flows from the tunnel through tube 23, the water level rises in 24 and flow through drain tube 25 occurs. Of course, the water level will not rise above the level of drain tube 25, and at all times the water in receiver 24 blocks ozone (and its carrier gas) from freely flowing out of the central area of section 10a. It should be noted that a small amount of ozone dissolved in the water will escape as the water leaves drain tube 25.

EXAMPLES

The invention is further demonstrated by the following illustrative examples. An apparatus in accordance with the attached drawings was employed.

In all experiments, plain jersey—17 courses/in, 14 wales/in. 2/20's (worsted count) yarn, 7.0 oz/yd$^2$ knitted fabric was used. The fabric was treated in two layers to simulate double folded areas such as the underarm areas of sweaters, etc.

Wash Tests

Each sample was washed 15 minutes at 41° C. with regular agitation in a top-loading domestic washer and then tumble-dried for 30 minutes according to AATCC method 124-1975 IB. The above procedure was repeated ten times. An area shrinkage of 5% of less (1st wash shrinkage was subtracted to eliminate shrinkage due to knitting strains) is considered an indication of good shrink-resistance.

EXAMPLE 1

Panels of the knitted fabric were manually placed on hooks on a conveyor. The temperature of the chamber (10*a*) was raised to 79° C. by introduction of steam and the fans were started. The flow of the ozone-air mixture (30 mg ozone/l of mixture) adjusted to 4.0 scfm (standard cubic feet per minute). The conveyor motor was started and the fabric was passed through chamber section 10*a* at a rate to achieve a residence time of 8.25 minutes. Additional panels of fabric were placed on the conveyor to replace those removed. The ozone concentration measured at the valves at the ends of middle section 10*a* averaged 1.73 mg/l; ozone utilization was, therefore, 94.3%. The amount of ozone injected per minute was 3.4 g to treat 145 g of fabric per minute and attain a shrinkage of 0±1%=according to the above-described procedure. Thus, the percentage of ozone employed to achieve 0% shrinkage was 2.3% owf (based on weight of fiber).

EXAMPLE 2

This example is not in accordance with the invention but is provided for purposes of comparison.

A portion of the aforementioned chamber was sealed at both ends after four panels of knitted fabric were hung therein. The valves at the top of the chamber were maintained in the open position to provide for pressure release. Ozone and steam were fed into the chamber under the conditions outlined in Example 1. It was determined that 8% ozone (owf) was required to achieve a shrink-resistance of 1±1%.

This experiment demonstrates the increased efficiency of the method of the invention over static processes; the former being 3.5 times as efficient as the latter.

EXAMPLE 3

This example is not in accordance with the invention but is provided for purposes of comparison.

The process of '906 as outlined in Example 1 therein, was followed; the reaction parameters were: time of treatment=3 minutes, flow rate=0.1 cu.ft./min., ozone concentration=50 mg ozone per liter of ozone-air mixture, 31.4 mg ozone per liter of ozone-steam mixture. It was determined that 10.6% ozone (owf) was required to achieve a shrink-resistance of 1±1%.

This experiment demonstrates the increased efficiency of the method of the invention over the prior art process. The former being 4.6 times as efficient as the latter.

Having thus described my invention, I claim:

1. An apparatus for treating fibers with an ozone-steam mixture, which comprises (a) a chamber having a substantially horizontal open end section, and a horizontal middle section elevated at least 15 cm above said end section, said middle section having a top wall which is sloped in both directions from a center line, the magnitude of slope being sufficient to convey condensed gases down the side walls of said middle section and said middle section having a length sufficient to provide a residence time within said middle section for fibers conveyed therein to be treated by the ozone-steam mixture prior to exiting said middle section;

(b) means for introducing ozone into the central longitudinal part of said horizontal middle section of said chamber; and separate means for introducing steam into the central longitudinal part of said horizontal middle section to create an ozone-steam mixture within said horizontal middle section, said means for introducing ozone and for introducing steam located within said horizontal middle section such that in conjunction with the elevation of said middle section said ozone-steam mixture is substantially confined therein; and (c) means for moving the fibers through said chamber.

2. The apparatus of claim 1 wherein the width of said horizontal middle section is sufficient to provide about 5 to 15 cm between the fibers to be treated and the walls of said section to provide intimate contact between the fibers and said ozone-steam mixture.

3. The apparatus of claim 1 which further includes baffle means within said horizontal middle section of said chamber for compartmentalizing the ozone-steam mixture in said horizontal middle section.

4. The apparatus of claim 1 which further includes interior auxiliary walls to compartmentalize said ozone-steam mixture in said horizontal middle section.

5. The apparatus of claim 1 which further includes means for cross-sectionally circulating the ozone-steam mixture within said horizontal middle section of said chamber.

6. The apparatus of claim 1 which further includes means for measuring the concentration of said ozone-steam mixture in said horizontal middle section of said chamber.

7. The apparatus of claim 1 which futher includes means for measuring the temperature of said horizontal middle section of said chamber.

8. The apparatus of claim 1 which further includes a sloping section connecting said open end section with said horizontal middle section.

* * * * *